US005655877A

United States Patent [19]

Yu

[11] Patent Number: 5,655,877

[45] Date of Patent: Aug. 12, 1997

[54] CEILING FAN HOUSING ASSEMBLY

[76] Inventor: Jack Yu, No. 109-1, Avenue 6, Lane 164, Tzong Sa Road, Da Du Hsiang, Taichung Hsien, Taiwan

[21] Appl. No.: 701,682

[22] Filed: Aug. 22, 1996

[51] Int. Cl.[6] ..... F04D 29/52; F04D 29/64

[52] U.S. Cl. ..... 416/5; 362/96; 362/122; 362/240; 362/294

[58] Field of Search ..... 416/5, 93 R, 170 R, 416/244 R; D23/377, 379, 385, 411; 417/360, 423.14; 415/214.1; 362/92, 122, 240, 149, 294, 373; 403/335, 336, 338; 411/84; 310/89; 285/46, 331

[56] References Cited

U.S. PATENT DOCUMENTS

| | | | |
|---|---|---|---|
| 4,363,083 | 12/1982 | Tanaka et al. | 362/294 |
| 4,402,649 | 9/1983 | Laurel | 416/5 |
| 4,626,970 | 12/1986 | Huang | 416/5 |
| 4,660,869 | 4/1987 | Gabus | 285/331 |
| 5,439,350 | 8/1995 | Yu | 416/5 |
| 5,441,387 | 8/1995 | Yu | 416/5 |
| 5,529,353 | 6/1996 | Kuo | 403/338 |
| 5,580,156 | 12/1996 | Suzuki et al. | 362/373 |

FOREIGN PATENT DOCUMENTS

| | | | |
|---|---|---|---|
| 0412686 | 8/1946 | Italy | 285/331 |

*Primary Examiner*—Christopher Verdier
*Attorney, Agent, or Firm*—Charles E. Baxley, Esq.

[57] ABSTRACT

A ceiling fan housing includes a cylindrical member of transparent material secured between a bottom plate and a cover. A casing is received in the cylindrical member and has one or more openings for engaging with one or more panels. One or more light bulbs are engaged in the casing for lighting the panels. The casing may include an outer peripheral portion having one or more beautiful patterns for forming beautiful lights and patterns when the light bulb is energized.

4 Claims, 3 Drawing Sheets

CEILING FAN HOUSING ASSEMBLY

BACKGROUND OF THE INVENTION

1. Field of the Invention

The present invention relates to a housing, and more particularly to a ceiling fan housing assembly.

2. Description of the Prior Art

The closest prior arts of which applicant are aware are U.S. Pat. Nos. 5,439,350, 5,441,387 and 5,503,524, all issued to Yu who is also the applicant of the present invention. The prior arts disclose a ceiling fan housing that includes a number of patterns or panels secured to the cylindrical member. However, the patterns may not be easily and solidly attached and secured to the cylindrical member which is made of glass material. In addition, the panels are exposed such that gaps are formed between the panels and the cylindrical member and such that the ceiling fan housing may not be easily cleaned.

The present invention has arisen to mitigate and/or obviate the afore-described disadvantages of the conventional ceiling fan housings.

SUMMARY OF THE INVENTION

The primary objective of the present invention is to provide a ceiling fan housing which includes a number of panels secured in a cylindrical member of glass or transparent material for allowing the patterns of the panels to be seen through the transparent cylindrical member.

In accordance with one aspect of the invention, there is provided a housing assembly for a ceiling fan comprising a cylindrical member made of transparent material, the cylindrical member including an upper portion and a lower portion, a bottom plate engaged with the lower portion of the cylindrical member, a cover engaged on the upper portion of the cylindrical member, a casing received in the cylindrical member and disposed between the bottom plate and the cover, the casing including at least one opening formed therein, at least one panel engaged in the opening of the casing, and a plurality of fastening members engaged through the cover and the panel and the bottom plate for securing the bottom plate and the cylindrical member and the cover together, and for securing the panel in place.

A board is engaged between the cylindrical member and the cover, and at least one light bulb is secured to the board for lighting the panel.

The cylindrical member includes a first annular flange formed in the upper portion, the casing includes an upper portion having a second annular flange formed thereon and, the housing further includes a ring having an annular groove formed therein for engaging with the first and the second annular flanges of the cylindrical member and the casing for securing the cylindrical member and the casing together.

The casing may include an outer peripheral portion having one or more beautiful patterns for forming beautiful lights and patterns when the light bulb is energized.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
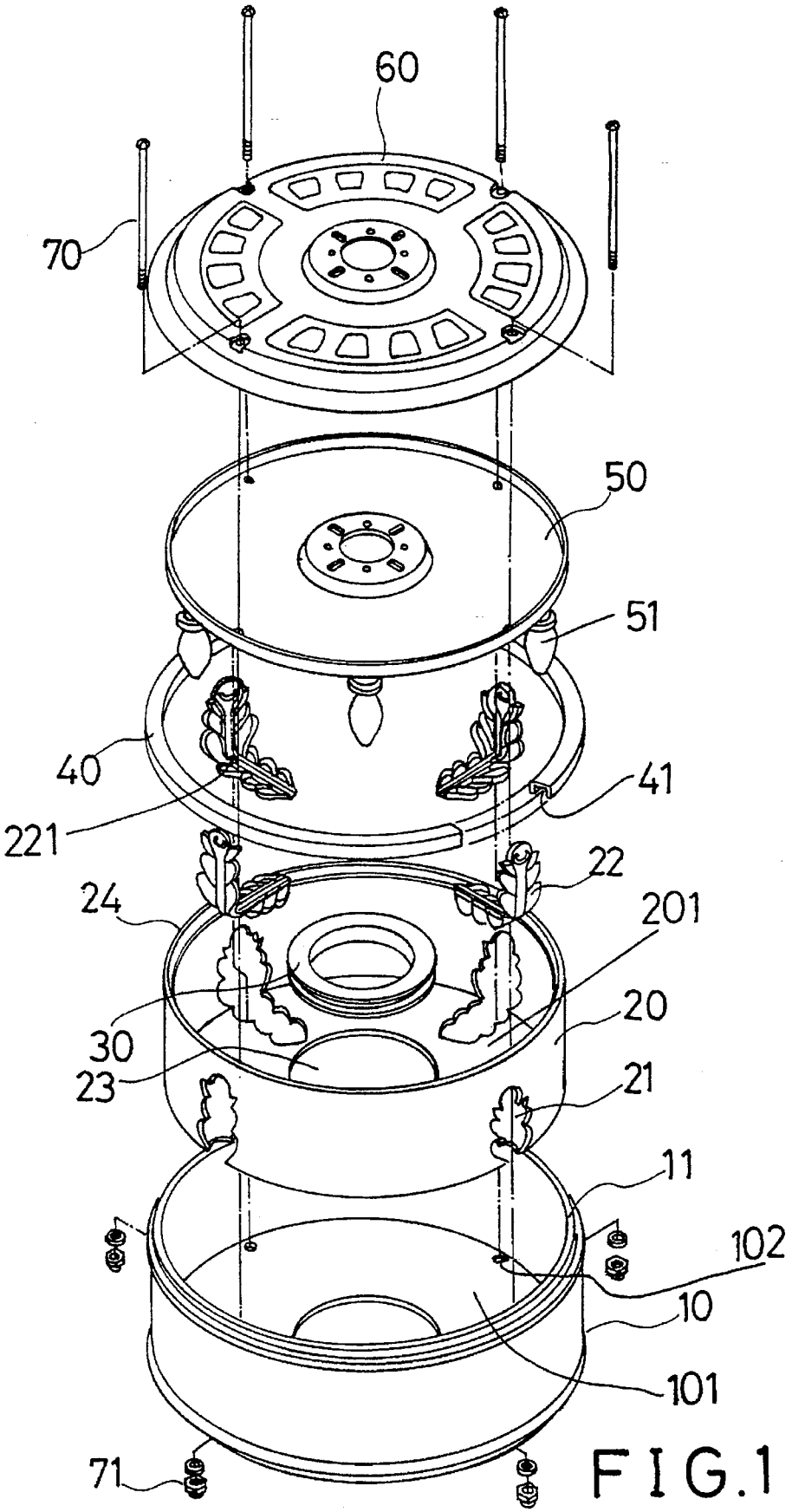
FIG. 1 is an exploded view of a ceiling fan housing assembly in accordance with the present invention.
Figure 2:
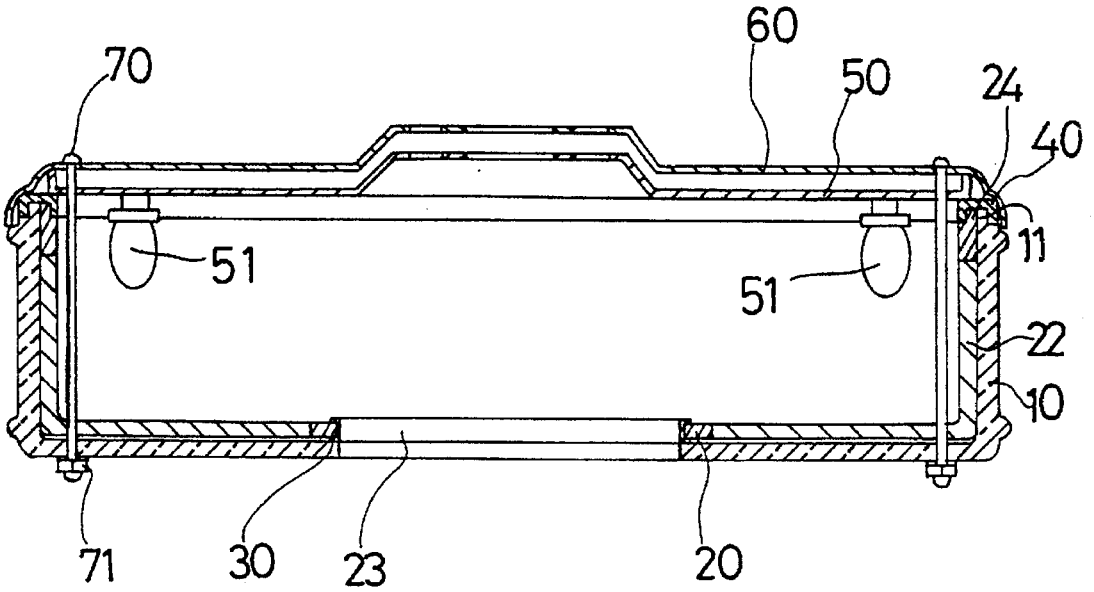
FIG. 2 is a cross sectional view of the ceiling fan housing assembly.

Referring to the drawings, and initially to FIGS. 1 and 2, a ceiling fan housing in accordance with the present invention comprises a cylindrical member 10 including a bottom plate 101 in the form of a peripheral flange extending radially inward from the bottom portion of the cylindrical member 10. The bottom plate 101 includes a number of holes 102 formed therein for engaging with bolts 70 which may engage with nuts 71. A board 50 and a cover 60 are engaged on the cylindrical member 10. The board 50 is provided for securing a number of light bulbs 51 thereto. The cylindrical member 10 includes an annular flange 11 extended upward from the upper portion.

A casing 20 is engaged in the cylindrical member 10 and includes a number of openings 21 formed therein for engaging with a number of panels 22 of suitable patterns respectively. The panels 22 each includes an orifice 221 formed therein for engaging with the bolts 70 so as to be secured in place by the bolts 70. The casing 20 includes a bottom wall 201 having a bore 23 and includes a resilient pad 30 of ring shape engaged on the peripheral edge for defining the bore 23. The bolts 70 are engaged through the cover 60 and the board 50 and the bottom plate 101 of the cylindrical member 10 and are engaged With the nuts 71 so as to secure the cover 60 and the board 50 and the cylindrical member 10 together. The bolts 70 also engage through the panels 22 for securing the panels 22 in place. The panels 22 are engaged in the openings 21 of the casing 20 which is engaged in the cylindrical member 10 such that the casing 20 can be retained in place by the panels 22 and may be prevented from rotating relative to the cylindrical member 10. The casing 20 includes an annular flange 24 extending upward from the upper portion and arranged in abutment with the annular flange 11 of the cylindrical member 10. A ring 40 includes an annular groove 41 formed in the bottom portion for engaging with the annular flanges 11, 24 of the cylindrical member 10 and the casing 20 (FIG. 2) so as to further secure the casing 20 to the cylindrical member 10.

It is to be noted that the cylindrical member 10 is made of transparent material, such as glass. The casing 20 is also made of transparent material, such as plastic or acrylic material, for allowing the panels 22 to be seen through the transparent cylindrical member 10. Beautiful lights and shapes may be formed when the light bulbs 51 are energized. It is further to be noted that the bottom plate 101 is not necessary to be formed integral with the cylindrical member 10 and may be separated from the cylindrical member 10. The panels 22 are not necessary to be secured to the cylindrical member 10 such that the cylindrical member 10 will not be easily broken when the cylindrical member 10 is made of glass material.

Figure 4:
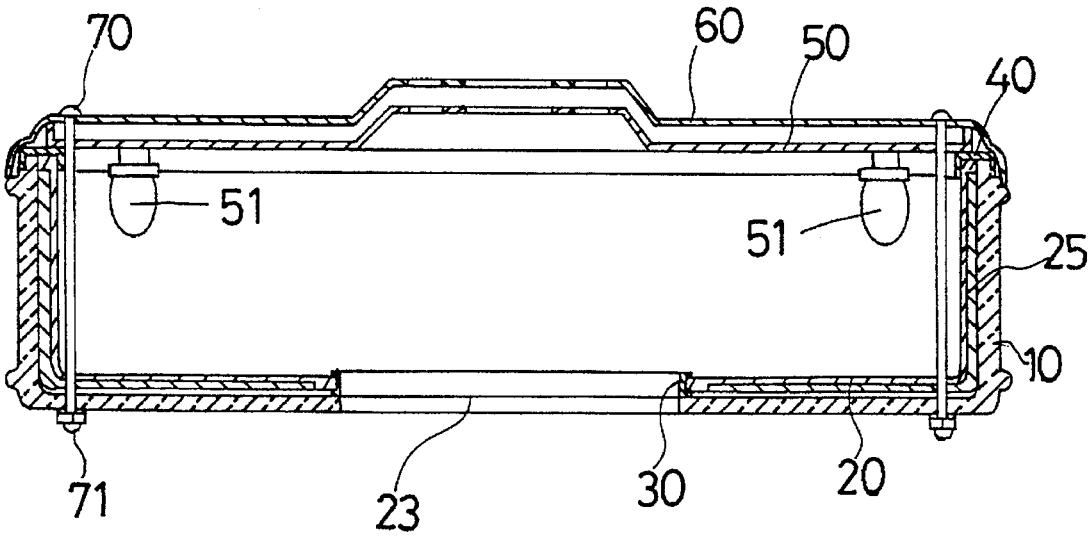
FIG. 4 is a cross sectional view of the ceiling fan housing assembly as shown in FIG. 3.
Figure 3:
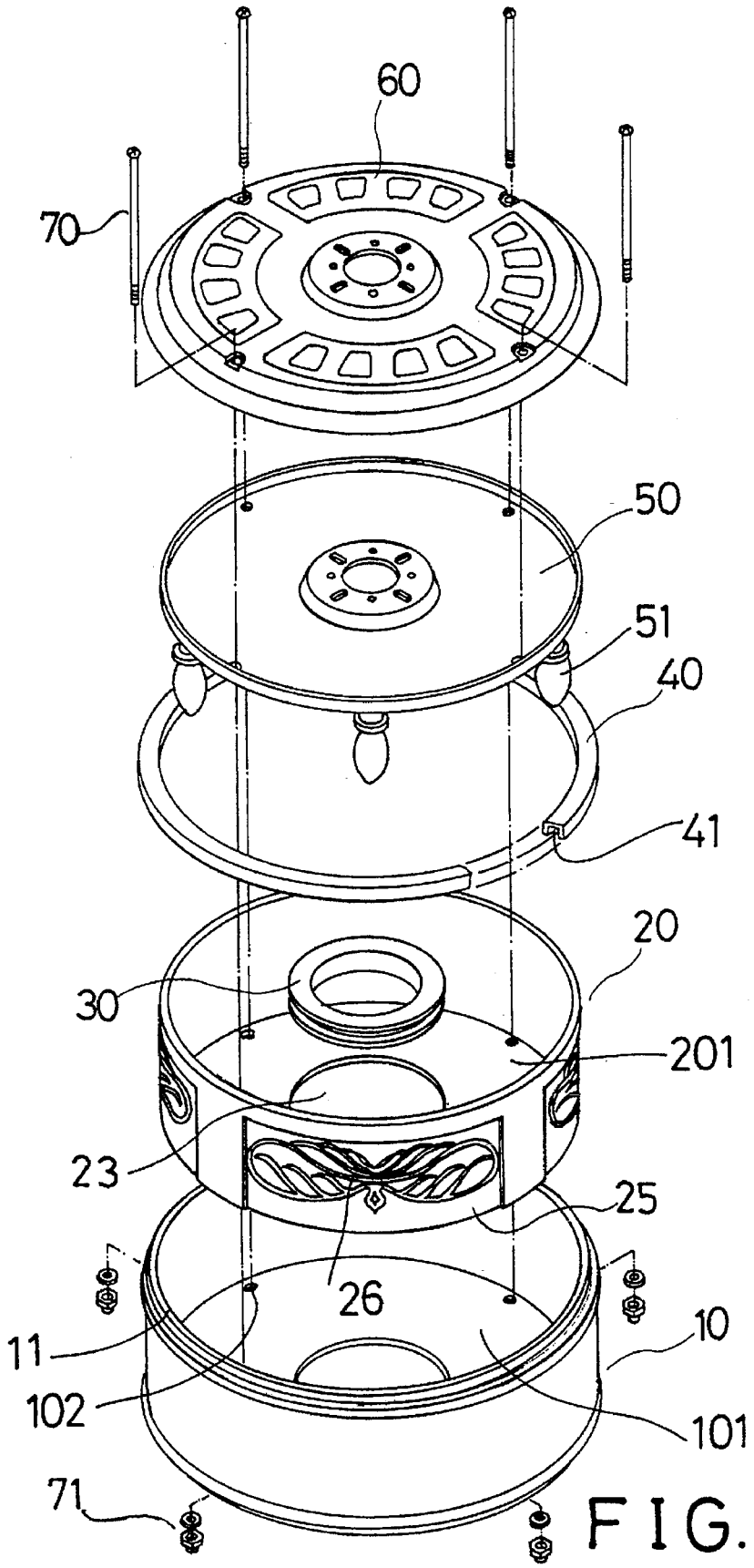
FIG. 3 is an exploded view showing another application of the ceiling fan housing assembly.

Referring next to FIGS. 3 and 4, instead of the openings 21 and the panels 22 as shown in FIGS. 1 and 2, the casing 20 includes a number of depressions 25 formed in the outer peripheral portion thereof for applying a number of beautiful patterns 26 to the casing 20 and in the depressions 25. Again, beautiful lights and shapes may be formed when the light bulbs 51 are energized.

Accordingly, the ceiling fan housing in accordance with the present invention includes a casing engaged in the cylindrical member and having a number of panels or patterns formed in the casing without attaching to the cylindrical member such that the cylindrical member can be prevented from being broken.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A housing for a ceiling fan comprising:

a cylindrical member made of transparent material, said cylindrical member including an upper portion and including a lower portion having a bottom plate, said cylindrical member including a first annular flange formed in said upper portion, a cover engaged on said upper portion of said cylindrical member, a casing received in said cylindrical member and disposed between said bottom plate and said cover, said casing including at least one opening formed therein, said casing including an upper portion having a second annular flange formed thereon, a ring including an annular groove formed therein for engaging with said first and said second annular flanges of said cylindrical member and said casing, respectively, and for securing said cylindrical member and said casing together, at least one panel engaged in said at least one opening of said casing, and a plurality of fastening members engaged through said cover and said at least one panel and said bottom plate for securing said bottom plate and said cylindrical member and said cover together, and for securing said at least one panel in place.

2. A housing according to claim 1 further comprising a board engaged between said cylindrical member and said cover, and at least one light bulb secured to said board for lighting said panel.

3. A housing for a ceiling fan comprising:

a cylindrical member made of transparent material, said cylindrical member including an upper portion and including a lower portion having a bottom plate, said cylindrical member including a first annular flange formed in said upper portion, a cover engaged on said upper portion of said cylindrical member, a casing received in said cylindrical member and disposed between said bottom plate and said cover, said casing including an outer peripheral portion having at least one pattern provided therein, said casing including an upper portion having a second annular flange formed thereon, a ring including an annular groove formed therein for engaging with said first and said second annular flanges of said cylindrical member and said casing, respectively, and for securing said cylindrical member and said casing together, and a plurality of fastening members engaged through said cover and said casing and said bottom plate for securing said bottom plate and said cylindrical member and said cover together, and for securing said casing in place.

4. A housing according to claim 3 further comprising a board engaged between said cylindrical member and said cover, and at least one light bulb secured to said board for lighting purposes.

* * * * *